United States Patent [19]

Ullman

[11] Patent Number: 4,669,765

[45] Date of Patent: Jun. 2, 1987

[54] LOCKABLE LATCH FOR TILTABLE DOUBLE HUNG WINDOWS

[75] Inventor: Myron Ullman, Canfield, Ohio

[73] Assignee: Kessler Products Company, Inc., Youngstown, Ohio

[21] Appl. No.: 918,306

[22] Filed: Oct. 14, 1986

Related U.S. Application Data

[63] Continuation-in-part of Ser. No. 836,136, Mar. 4, 1986, abandoned.

[51] Int. Cl.[4] ..... E05C 1/04

[52] U.S. Cl. ..... 292/153; 292/175

[58] Field of Search ..... 292/153, 175

[56] References Cited

U.S. PATENT DOCUMENTS

| | | | |
|---|---|---|---|
| 26,518 | 12/1859 | Page | 292/153 |
| 137,211 | 3/1873 | Jones | 292/153 X |
| 472,088 | 4/1892 | Walker | 292/153 X |
| 742,881 | 11/1903 | Little | 292/153 X |
| 1,187,751 | 6/1916 | Lotz | 292/175 |
| 1,689,101 | 10/1928 | Beck | 292/175 |
| 3,937,503 | 2/1976 | Harris | 292/153 |
| 4,475,311 | 10/1984 | Gibson | 292/153 X |

*Primary Examiner*—Robert L. Wolfe
*Assistant Examiner*—Lloyd A. Gall
*Attorney, Agent, or Firm*—Browdy and Neimark

[57] ABSTRACT

A lockable window latch for double hung windows which pivots for cleaning includes an outer shell, a latching member which is slidable therein and a locking member which is rotatably received in the latching member and projects through an opening in the front wall of the shell. The locking element has an elongated control portion or handle which, when aligned transverse to the length of the latch permits latching and unlatching. When the handle is turned 90° so as to be aligned with the length of the latch, one of its ends abuts against an internal wall surface of the shell thereby preventing unlatching.

9 Claims, 9 Drawing Figures

LOCKABLE LATCH FOR TILTABLE DOUBLE HUNG WINDOWS

This is a continuation-in-part application of copending parent application Ser. No. 836,136 filed Mar. 4, 1986, now abandoned.

FIELD OF THE INVENTION

The present invention relates to security and, more particularly, to a lockable latch for tiltable double-hung windows.

BACKGROUND OF THE INVENTION

Modern double hung windows are provided with pivot means along the central portion thereof so that the window can be pivoted or tilted along the axis of the pivots out of the plane of the casing to open the windows for ease of cleaning. In order to maintain the windows in place in their normal mode of operation, sliding latches are normally provided which, when engaged, maintain the windows in the same general plane as the window casing. However, these conventional constructions lack sufficient security.

More recently, a window latch for this type of window has appeared which has a locking means similar to that of Gibson U.S. Pat. No. 4,475,311. However, this type of construction has a rotatable locking element which has an upper end in the form of a screw head and a lower end having a bar eccentrically mounted thereon. When a screwdriver is inserted into the screw head and rotated, the bar may be aligned either adjacent the interior end of the latch thereby preventing the latch from being displaced (i.e. a locking mode), or it may be turned 180° to the unlocking mode so that the bar does not interfere with the movement of the latch. This construction requires the use of a screwdriver to lock and unlock, and is therefore difficult and inconvenient to use. The overall construction of this device does not suggest a way to avoid the use of a screw head, while still maintaining a latch construction which is otherwise satisfactory.

Many general purpose lockable latches exist. Among these is the 1859 U.S. Pat. No. 26,518 in the name of Page for a slidable door bolt; U.S. Pat. No. 1,689,101 to Beck which shows a fastening mechanism for a grave vault; and U.S. Pat. No. 742,881 in the name of Little directed to a metallic door bolt, catch and locking button including a spring-actuated sliding bolt. However, these devices are archaic in construction, in some cases being unduly complex, and are unsuitable for use in the present environment.

SUMMARY OF THE INVENTION

It is, accordingly, an object of the invention to overcome the deficiencies of the prior art, such as indicated above.

It is another object to provide for improved security, especially with respect to the locking of window latches.

It is a further object of the invention to provide an improved lockable window latch for slidable and tiltable double hung windows.

These and other objects and the nature and advantages of the instant invention will be more apparent from the following detailed description, taken in conjunction with the drawing, wherein:

DETAILED DESCRIPTION OF PREFERRED EMBODIMENTS

Figure 1:
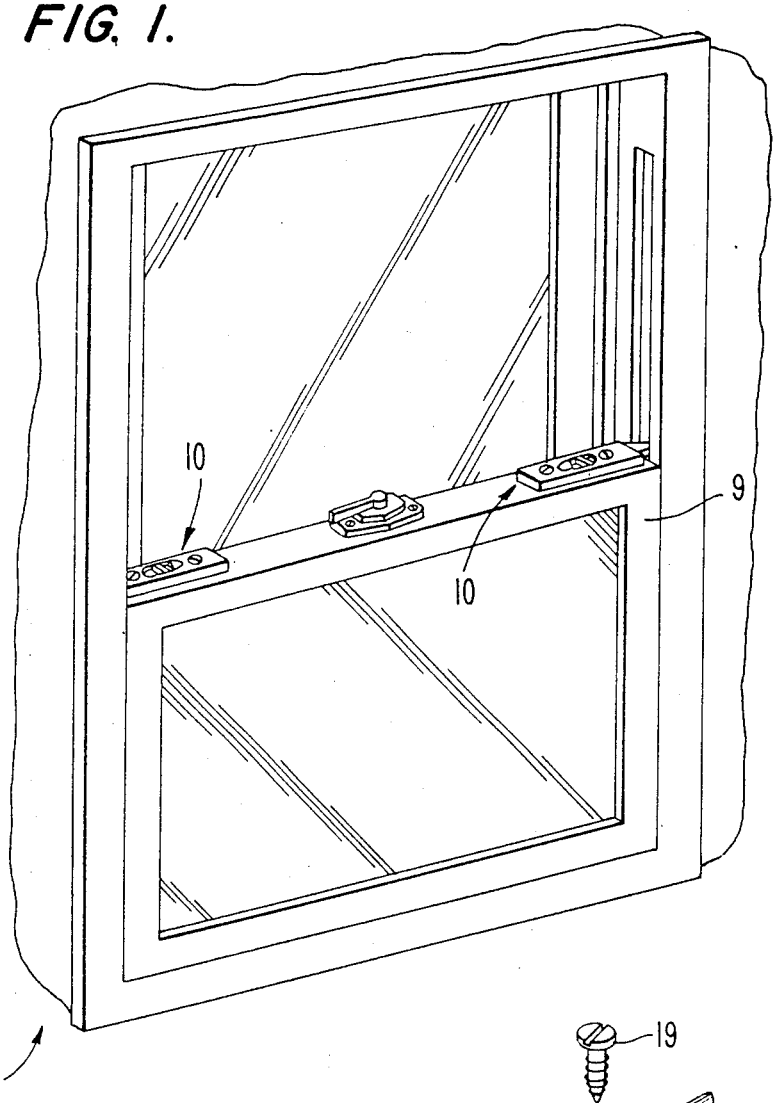
FIG. 1 is a perspective view of a form of window construction employing a lockable latch according to the present invention.
Figure 2:
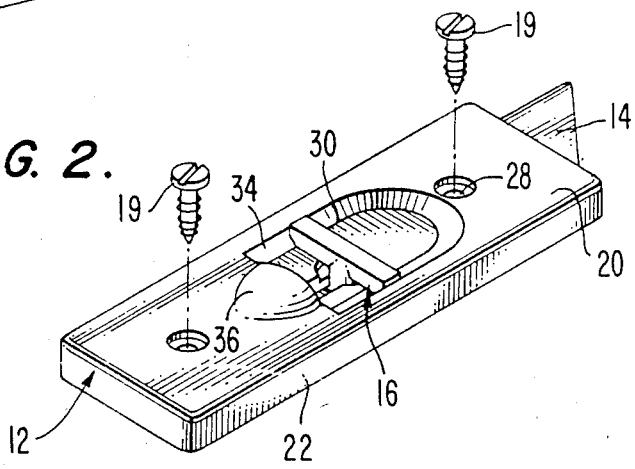
FIG. 2 is a front perspective view of a first preferred embodiment of a lockable latch according to the present invention with the lock unlocked position.

A pair of lockable window latches 10 according to the present invention for a double hung window 8 which pivots in the middle for cleaning is generally shown in FIG. 1. In a first embodiment, shown in FIGS. 2–6,. the latch 10 generally comprises an outer generally rectangular mountable box 12, a slidable latching element 14, a hand turnable lock 16 and a pair of biasing springs 18. It will therefore be seen that in addition to a pair of mounting screws 19 and the two springs 18, the instant device is formed of only three elements, all of which may be easily and simply injection molded of suitable plastic, such as vinyl plastic, polyolefin, nylon, polycarbonate or acetal resin.

The generally rectangular box or shell 12 has a facing wall 20, a pair of opposite side walls 22 and a rear end wall 24. Extending from the facing wall 20 the thickness of the shell 12 are a pair of cylindrical formations 26 containing mounting holes 28 through which suitable screws 19 or the like can be passed when mounting the latch 10 to the frame 9. An elongated opening 30 is provided in the facing wall 20, defined by one or more interior walls including a rear wall 32 and a preferably sloped U-shaped wall 34. The rear wall 32 of the hole 30 also defines the front end of a sloped thickened portion 36 of the facing wall 20.

Figure 3:
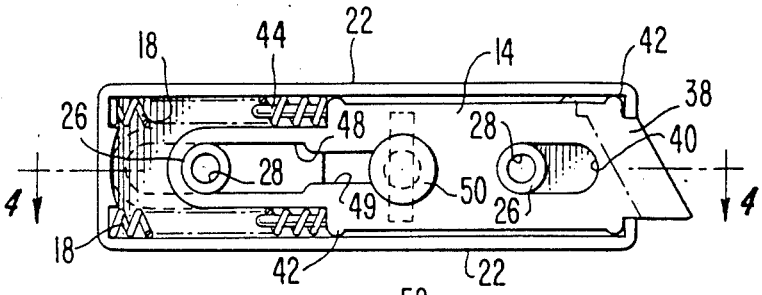
FIG. 3 is a bottom plan view of the lockable latch of FIG. 2.
Figure 6:
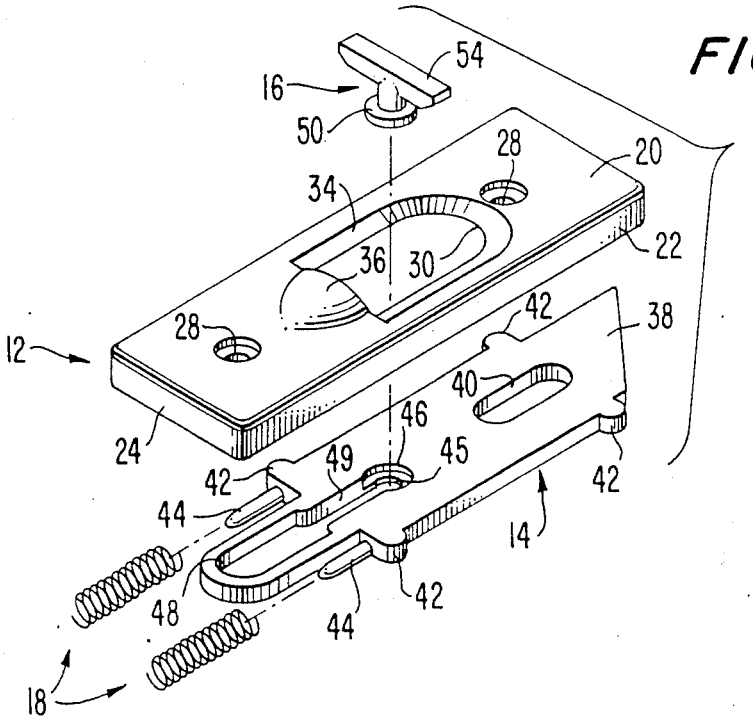
FIG. 6 is an exploded perspective view of the latch of FIGS. 2–5.

The slidable latching member 14, best seen in FIGS. 3 and 6, has a sloped interlockable nose element 38 which projects through the front open end of the box or shell 12 in its normal spring biased position. The latching member 14 has an elongated slot 40 which receives the forward-most cylindrical formation 26, whereby it will be understood that the sliding interrelationship between the elongated slot 40 and its corresponding cylindrical formation 26 helps to guide correct linear sliding movement of the latching member 14 within the shell 12, it being further understood that the cylindrical formation 26 has an external diameter slightly smaller than the internal width of the slot 40. Also assisting in this guiding motion are four protuberances 42 which slide along the interior surfaces of the opposite side walls 22, and it will be understood that the two protuberances 42 shown at the right in FIG. 3 also prevent escape of the latching member 14 from the front open end of the shell 12.

The latching member 14 is also provided with a pair of rearwardly projecting spring-retaining prongs 44, and with a circular bore 45 having a circular recess 46, and a second elongated slot 48, the latter of which cooperates with the rearmost of the two cylindrical formations 26 in much the same way as the foremost cylindrical formation 26 cooperates with the elongated slot 40. The circular recess 46 is preferably directly adjacent a narrow extension 49 of the slot 48 to permit ease of assembly of the lock 16 with the shell 12 and latching element 14.

The lock 16 comprises a rotatable circular base 50 which is received in the circular recess 46 of the latching member 14, a cylindrical post 52 extending upwardly therefrom toward the facing surface 20 of the shell 12, and an upper elongated control element 54 which is grasped by the user to control both the sliding motion of the latching member 14 and the locking and unlocking motion of the lock 16. The post 52 cooperates and mates with the bore 45 of the latching member 15.

In the position shown in FIGS. 2–4 and 6, i.e. the unlocked position, the user grasps the control element 54 and moves it to the left until the control element 54 is stopped by the interior rear wall 32 of the elongated opening 30. Due to the cooperation between the circular base 50 and the mating recess 46, this movement causes rearward movement of the latching member 14, to the left in FIG. 2 against the action of the springs 18, with resultant disengagement between the latch nose 38 and its receptacle so as to permit the double hung windows to be pivoted for cleaning.

Figure 5:
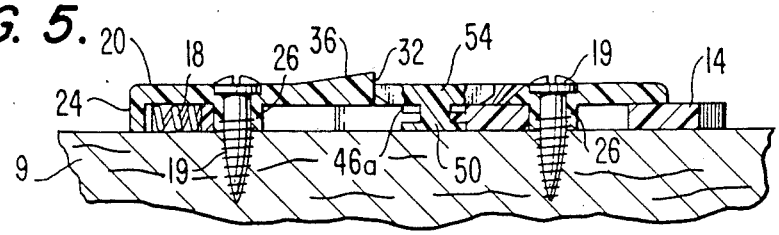
FIG. 5 is a sectional view like FIG. 4, except that the latch is shown in the locked position.

When it is desired to lock the latch to prevent unlatching, the control element 54 is merely rotated 90° as shown in FIG. 5; this is permitted because the circular base 50 is rotatably retained in its circular recess 46, while the post 52 is rotatably retained in the bore 45, and therefore the lock 16 is rotatable relative to the latching element 14. When the control element 54 has been rotated 90°, its axis is then aligned with the length of the latching member 14 with one of its ends abutting the front end 32 of the enlargement 36 of the shell 12.

Figure 4:
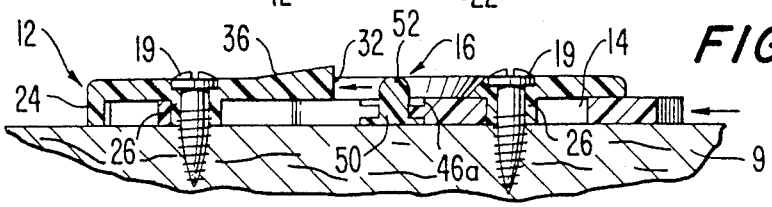
FIG. 4 is a sectional view taken along lines 4—4 of FIG. 3.

As can be best seen in FIGS. 4 and 5, the latching member 14 is provided on its opposite surface with a second circular recess **46*a*. This permits the latching member 14 to be flipped over so that the circular base 50 can cooperate with the circular recess 46*a*, whereby the lockable latch 10 can be used for the other side of the window. In other words, because the latching member 14 is the same on both surfaces, one such surface being provided with a circular recess 46 and the other with a circular recess 46*a*, the latch can be assembled for either the left side of the window or the right side of the window as shown in FIG. 1**. In this way, separate elements are not needed, depending on whether a left side or a right side latch is being provided.

Figure 7:
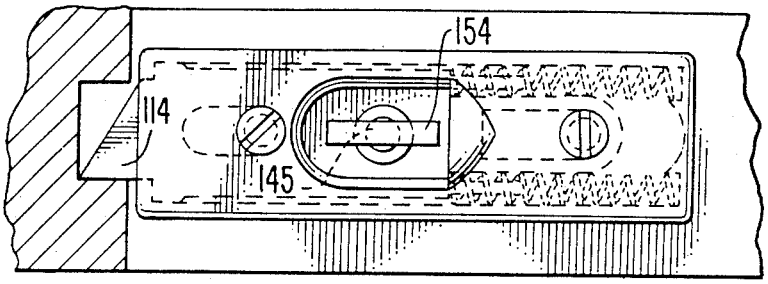
FIG. 7 is a top elevational view of a second preferred embodiment of a lockable latch according to the present invention, in the locked position.
Figure 8:
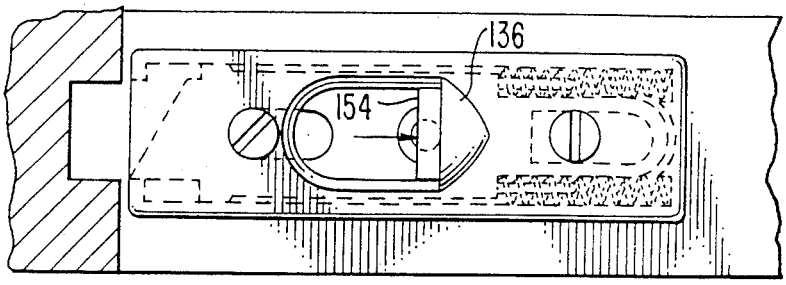
FIG. 8 is a top perspective view of the embodiment of FIG. 7 in the unlocked and unlatched position.
Figure 9:
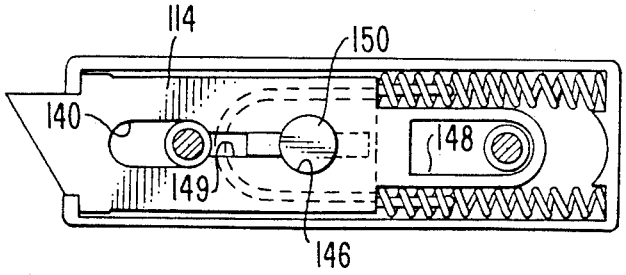
FIG. 9 is a bottom plan view of the lockable latch of FIGS. 7 and 8.

With reference to FIGS. 7–9, a second preferred embodiment is shown which, in many respects, is identical with the first embodiment of FIGS. 2–6. In the embodiment of FIGS. 7–9, the latching member 114 has its forwardmost elongated slot 140 (rather than its rearwardmost slot 148) provided with a narrow extension 149 leading to its recess 146 and bore 145. This construction is otherwise similar to the first described embodiment above.

The embodiment of FIGS. 7–9 provides a somewhat simpler assembly of the lock with the shell and latching element by passage of the control element 154 through the slot 149 in the position shown in FIG. 7, whereby the circular base 150 rotatably rests in the circular recess 146 as in the embodiment of FIGS. 2–6. As shown in FIG. 8, unlocking and unlatching is achieved by rotating the control element 154 and moving it to the right against the front wall of the thickened portion 146.

The present invention provides a number of advantages, several of which have been pointed out above. These are summarized below:

(1) There are no extra tools required to achieve locking. To the contrary, the real prior art (e.g. the Gibson U.S. Pat. No. 4,475,311) requires either a screwdriver or an Allen head wrench.

(2) How to achieve locking, unlocking, latching and unlatching is clear to the user-consumer without instruction. It is impossible to move the latch when the device is locked. When it is unlocked (FIGS. 2–4 and 8) , the locking bar or control element 54, 154 is used to propel the latching element 14, 114 to disengagement.

(3) The same parts can be assembled for left and right hand applications.

(4) The use of a locking bar or control element 54, 154 instead of a hole for actuating the latch makes the device easy to actuate and more positive to move.

(5) The spring retention means 44 are important during shipping and handling as they prevent loss of the springs.

(6) The provision of the raised area 36, 136 behind the locking bar or control element 54, 154 prevents tampering from the outside by use of a wire or similar device. When the device is in its locked position, a prod cannot be pushed in from behind to turn and de-activate the locking bar 54, 154.

(7) The latch and locking bar can be mounted and shipped together, preventing a loss of parts during shipment. The dealer can then dis-assemble and re-assemble left and right hand latches, as desired.

(8) When the lock bar or control element 54, 154 is installed by inserting same through the narrow slot 49, 149, it remains in its assembled position no matter how the device is shaken during either shipping or after assembly. In devices of the type such as shown in Gibson U.S. Pat. No. 4,475,311, the lock can easily fall out when the device is picked up. Even though the present device does not easily fall apart, it is very easily assembled.

(9) Use of plastic as a material eliminates sharp edges and never requires a lubricant.

The foregoing description of the specific embodiment will so fully reveal the general nature of the invention that others can, by applying current knowledge, readily modify and/or adapt such specific embodiment without departing from the generic concept, and therefore such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A lockable latch for a pivotable double hung window, comprising:

a mountable shell of generally rectangular configuration having a facing wall, a pair of side walls, a rear end wall, an open back and an open front end wall, said shell having an elongated opening near the center thereof extending through said facing wall, and a pair of cylindrical formations extending generally the thickness of said shell from said facing wall with openings therethrough for attaching screws or the like;

a slidable latching member received within said shell and having a nose normally projecting through the open front end wall of said shell, said latching member having a pair of elongated slots through which said cylindrical formations of said shell project in sliding relationship, said latching member having a circular recess in its bottom surface; and a locking element comprising a circular base received in said circular recess of said latching member, a post extending upwardly from said circular base and extending through said latching member, and an elongated finger activatable control element extending perpendicularly from said post, said locking element being rotatable between an unlocked position wherein the length of said control element is perpendicular to the length of said latching member, to a locking position wherein the length of said control element is aligned with the length of said latching member wherein an end of said control element abuts against a wall of said shell defining the elongated central opening of said shell, thereby preventing sliding motion between said latching member and said shell and maintaining the nose of said latching member projecting through the front end wall opening of said shell.

2. A latch according to claim 1, wherein said latching member is spring biased with its nose projecting through the open front end wall of said shell.

3. A latch according to claim 1, wherein said shell is provided with a thickened enlargement adjacent its central opening so as to define an enlarged wall against which an end of said control element abuts in the locking position.

4. A latch according to claim 1, wherein said latching member has two side walls each provided with two protuberances for sliding against the interior of the side, walls of said shell, and for preventing escape of said latching member through the open front end wall of said shell.

5. A latch according to claim 1, wherein said circular recess of said latch is connected to one of said elongated slots to permit easy insertion of said control member through said slot.

6. A latch according to claim 1, wherein said latching member has a said circular recess on both of its surfaces.

7. a latch according to claim 1, wherein said shell, said latching member and said locking element are formed of plastic.

8. A latch according to claim 2, wherein said latching member comprises spring retaining means.

9. A latch according to claim 8, wherein said spring retaining means comprise a pair of prongs.

* * * * *